US010096953B1

(12) United States Patent
Finnestad et al.

(10) Patent No.: US 10,096,953 B1
(45) Date of Patent: Oct. 9, 2018

(54) METHODS AND APPARATUS FOR SHIELDED AND GROUNDED CABLE SYSTEM

(71) Applicant: High Speed Interconnects, LLC, Scottsdale, AZ (US)

(72) Inventors: Donovan Finnestad, Portland, OR (US); James Alexander Moss, Portland, OR (US); Antonio De La Rosa, Scottsdale, AZ (US); Todd Albertson, Portland, OR (US)

(73) Assignee: High Speed Interconnects, LLC, Scottsdale, AZ (US)

( * ) Notice: Subject to any disclaimer, the term of this patent is extended or adjusted under 35 U.S.C. 154(b) by 20 days.

(21) Appl. No.: 15/630,220

(22) Filed: Jun. 22, 2017

(51) Int. Cl.
*H01R 9/00* (2006.01)
*H01R 12/50* (2011.01)
*H01R 13/658* (2011.01)
*H01B 11/20* (2006.01)

(52) U.S. Cl.
CPC ..... *H01R 23/688* (2013.01); *H01B 11/206* (2013.01); *H01R 13/65802* (2013.01)

(58) Field of Classification Search
CPC ..... H01B 7/17; H01B 7/28; H01B 11/18
USPC ..... 174/102 R, 103, 106 R, 110 R
See application file for complete search history.

(56) References Cited

U.S. PATENT DOCUMENTS 2,981,788 A * 4/1961 Bunish ..... H01B 9/028 174/103
3,211,821 A * 10/1965 Wakefield ..... H01B 7/02 174/103
3,614,300 A * 10/1971 Wilson ..... H01B 7/182 174/110 R
3,651,243 A * 3/1972 Hornor ..... H01B 11/20 174/103
3,673,315 A * 6/1972 Lasley ..... H01B 9/022 174/107
3,816,644 A * 6/1974 Giffel ..... H01B 7/04 174/113 R
4,234,759 A * 11/1980 Harlow ..... H01B 7/0838 174/103
4,358,636 A * 11/1982 Ijff ..... H01B 11/20 174/103
4,374,299 A * 2/1983 Kincaid ..... H01B 11/1091 174/105 SC
4,552,989 A * 11/1985 Sass ..... H01B 11/20 174/103
4,860,343 A * 8/1989 Zetena, Jr. ..... G06F 13/409 174/34
5,416,269 A * 5/1995 Kemp ..... H01B 7/1855 174/107
5,956,445 A * 9/1999 Deitz, Sr. ..... G02B 6/441 174/24
6,444,902 B1 * 9/2002 Tsao ..... H01B 7/0861 174/113 R (Continued)

*Primary Examiner* — William H Mayo, III
(74) *Attorney, Agent, or Firm* — The Noblitt Group, PLLC

(57) ABSTRACT

Methods and apparatus for a shielded and grounded cable assembly include a coaxial cable assembly having a uniform spacing between cables to pre-align the cable assembly in an array corresponding to a connection layout of at a source end. The cable assembly includes a plurality of coaxial cables with exposed shields that are commonly grounded to a drain wire. The cable assembly may also be configured to be connected vertically/perpendicularly to a ball grid array or edge connected to a circuit board.

21 Claims, 6 Drawing Sheets

(56) References Cited

U.S. PATENT DOCUMENTS

| | | | | |
|---|---|---|---|---|
| 6,486,395 | B1 * | 11/2002 | Temblador | H01B 9/02 174/102 R |
| 7,166,802 | B2 * | 1/2007 | Cusson | H01B 7/20 174/105 R |
| 7,309,835 | B2 * | 12/2007 | Morrison | H01B 9/02 174/74 R |
| 7,518,063 | B2 * | 4/2009 | Zhang | H01B 7/328 174/113 R |
| 8,039,749 | B2 * | 10/2011 | Okano | H01B 11/1008 174/113 R |
| 9,443,646 | B2 * | 9/2016 | Armbrecht | H01B 11/20 |
| 2004/0094328 | A1 * | 5/2004 | Fjelstad | H01R 9/0515 174/251 |
| 2005/0011664 | A1 * | 1/2005 | Lee | H01B 11/1033 174/102 SC |
| 2005/0208828 | A1 * | 9/2005 | Miller | H01R 9/0515 439/581 |
| 2010/0051318 | A1 * | 3/2010 | Wang | H01B 11/12 174/113 R |
| 2010/0084157 | A1 * | 4/2010 | Wang | H01B 11/12 174/107 |
| 2015/0034358 | A1 * | 2/2015 | Armbrecht | H01B 11/005 174/103 |

* cited by examiner

METHODS AND APPARATUS FOR SHIELDED AND GROUNDED CABLE SYSTEM

BACKGROUND OF THE TECHNOLOGY

Micro sensing devices such as CMOS imaging sensors, arrays, or cameras require small form factors that inherently create installation and manufacturing concerns for discrete cable or coaxial cable termination. For example, devices such as CMOS imaging sensors, arrays or cameras typically have a ball grid array to facilitate the signal transfers to or from the device and/or to provide power. However, because these types of devices have size constraints on the order of 3 millimeters or less, cable design and proper termination of the cable at the device can be problematic.

Common methods of terminating shielded or coaxial cables to ball grid arrays (BGA) or other CMOS based circuit or substrate may require the use of a jumper cable or wire that is connected on a first end to a shield of any wire to a ground connection on the BGA or substrate on a second end. More simply, a jumper wire is a separate wire that is not part of the coaxial cable but is required to provide an adequate ground. Multiple jumper wires may be required in cable assemblies that incorporate more than one coaxial cable. These jumper wires may be on the nominal order of a few millimeters in length and create a manufacturing concern since connecting such a small length of wire within the space constraints of the assembly requires precision slowing down the manufacturing process and potentially leading to excessive manufacturing efficiencies or assembly quality problems.

Further, the use of jumper wires increases the required termination region/distance and/or a corresponding outer diameter of the termination. This may lead to a situation where the outer diameter of the termination or the length of the termination region exceeds an allowed size constraint for a particular device type or application.

SUMMARY OF THE TECHNOLOGY

Methods and apparatus for a shielded and grounded cable assembly according to various aspects of the present technology include a coaxial cable assembly having enhanced connection and termination capabilities. In one embodiment, the cable assembly comprises a plurality of coaxial cables with exposed shields that are commonly grounded to a drain wire. The cable assembly may also be configured to be connected vertically/perpendicularly to a ball grid array or edge connected to a circuit board.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps.

Such functional blocks may be realized by any number of hardware or software components configured to perform the specified functions and achieve the various results. For example, the present technology may employ various cables, sensors, dielectrics, connection types, circuit cards/boards, and the like, which may carry out a variety of analog or digital (MIPI) functions. In addition, the present technology may be practiced in conjunction with any number of applications, and the system described is merely one exemplary application for the technology. Further, the present technology may employ any number of conventional techniques for providing analog or digital (MIPI) control signals, reducing noise, cross-talk, attenuation, impedance, controlling power, and the like.

Methods and apparatus for an internally shielded and grounded cable system according to various aspects of the present technology may operate in conjunction with any suitable electronic sensor, video system, data collection system, and/or other electronic device. Various representative implementations of the present technology may be applied to any appropriate system for imaging such as a temporarily insertable camera system.

Figure 1:
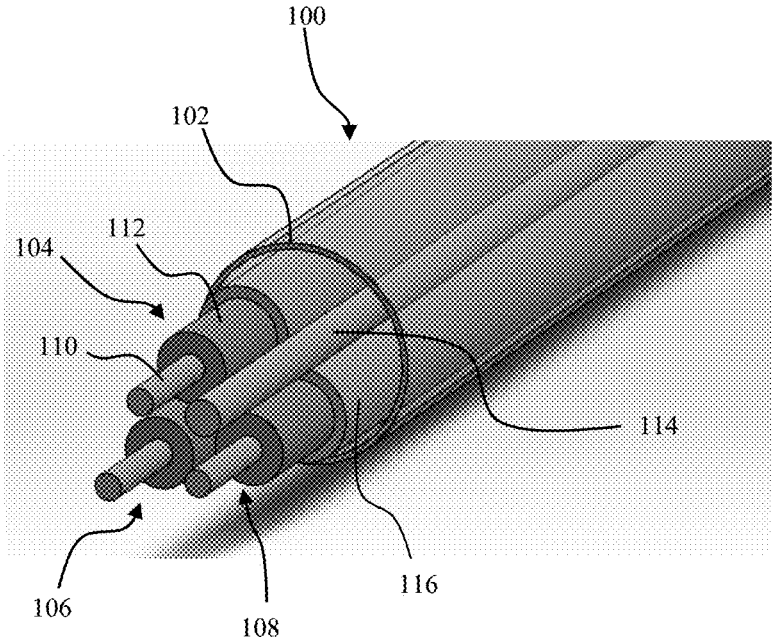
FIG. 1 representatively illustrates a perspective cutaway view of a cable assembly in accordance with an exemplary embodiment of the present technology.
Figure 2:
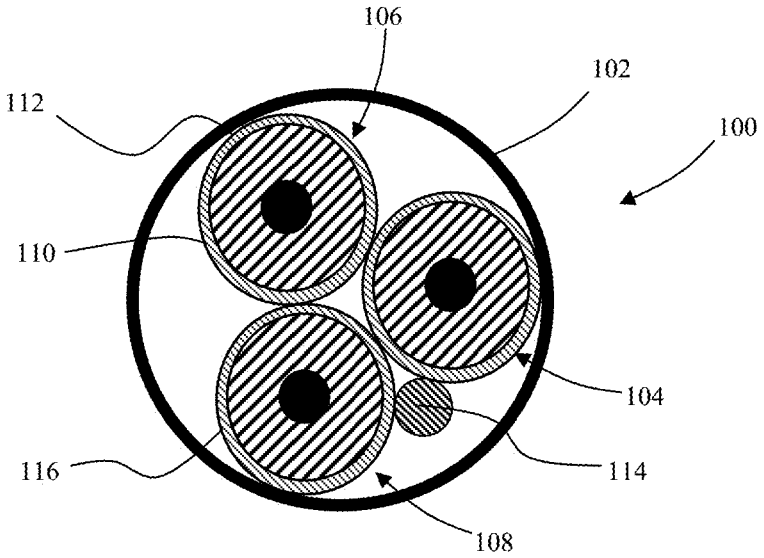
FIG. 2 representatively illustrates a detailed view of the common grounding for the cable assembly in accordance with an exemplary embodiment of the present technology.
Figure 3:
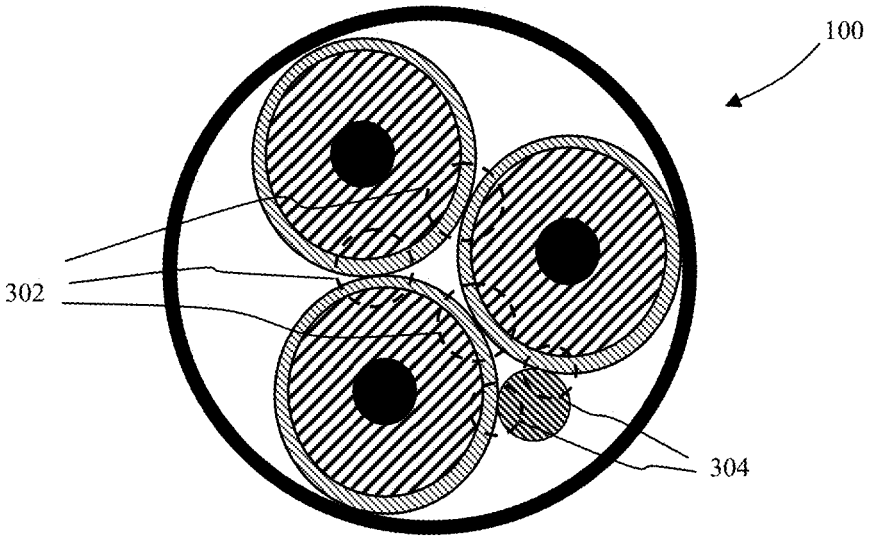
FIG. 3 representatively illustrates a cross-sectional view of the cable assembly in accordance with an exemplary embodiment of the present technology.

Referring now to FIGS. 1, 2, and 3, an internally shielded and grounded cable assembly according to various aspects of the present technology may comprise a cable assembly 100 comprising one or more coaxial cables 104, 106, 108 disposed within an outer jacket 102. The coaxial cables may be configured such that they share a common ground in the form of a drain wire 114.

The coaxial cables 104, 106, 108 are used to transmit signals from a source device at a source end to a receiving end such as a display or memory device. The signals may comprise any suitable electrical signals, for example a combination of data, control signals, and power. For example, in one embodiment for use with an imaging system using a camera, a first coaxial cable 104 may provide electrical power to the camera. The camera may be configured with an integrated circuit such as a CMOS imaging sensor, an array, or other sensing device that is connected directly to the cable assembly 100. A second coaxial cable 106 may transmit a clock signal between the camera and the receiving end of the cable assembly 100. A third coaxial cable may transmit an image signal from the camera to the receiving end where the image signal may be displayed or analyzed for processing. In alternative embodiments, additional coaxial cables may be included to transmit additional power lines or signals as required. Similarly, fewer cables may be used if the particular application requires the transmission of fewer signals or less power lines through the cable assembly 100.

The coaxial cables 104, 106, 108 may comprise any suitable type of coaxial cable, such as a cable comprising a center conductor 110, a dielectric 112 surrounding the center conductor 110, and a shield 116 covering the dielectric 112. In one embodiment, the shield 116 of the coaxial cables 104, 106, 108 remains at least partially exposed along a length of the cable assembly 100. In a second embodiment, the shield 116 of the coaxial cables 104, 106, 108 is exposed along the entire length of the cable assembly 100. The shield 116 comprises an electrically conductive surface running the length of the cable assembly 100.

The coaxial cables 104, 106, 108 may be arranged within the outer jacket 102 such that electrically conductive surface of each shield 116 of each coaxial cable 104, 106, 108 is in direct contact 302 with the electrically conductive surface of least one other coaxial cable 104, 106, 108. This direct contact 302 allows two or more of the coaxial cables 104, 106, 108 to be grounded to each other. Therefore, by positioning the drain wire 114 within the outer jacket 102 such that the drain wire 114 is in direct contact 304 with at least one coaxial cable 104, 106, 108, the drain wire 114 may act as a common ground for one or more of the coaxial cables 104, 106, 108 when connected to a ground location such as a ball, pad, or other location used as an electrical ground. The drain wire 114 may be coextensive with the coaxial cables 104, 106, 108 along the entire length of the cable assembly 100.

Alternatively, the drain wire 114 may be coextensive with the coaxial cables 104, 106, 108 along the entire length of the cable assembly 100 but the shields of the coaxial cables 104, 106, 108 may only be exposed at the end portions of the cable assembly 100. For example, a portion of each coaxial cable 104, 106, 108 may be exposed at the source end and then the plurality of coaxial cables 104, 106, 108 may be secured together such that the exposed shields 116 of the coaxial cables 104, 106, 108 are in contact with each other and the drain wire 114 as described above. In yet another embodiment, the drain wire 114 may not extend the entire length of the cable assembly 100 and instead comprise a length of conductive wire at each of the source end and the receiving end. The drain wire 114 may then be coupled to the coaxial cables 104, 106, 108 to form a common ground as described above.

Figure 4A:
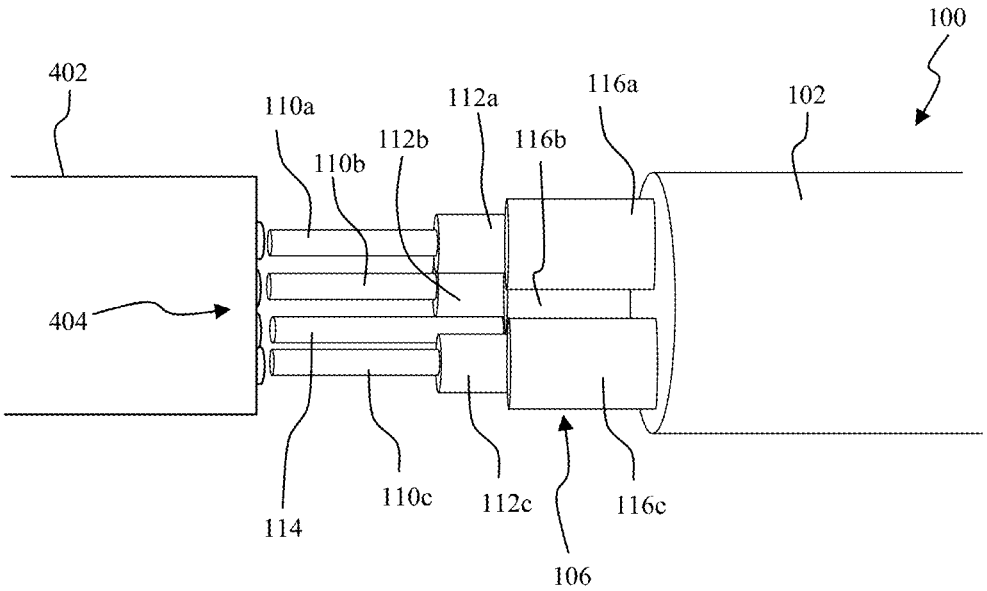
FIG. 4A representatively illustrates a side view of a vertical connection of the cable assembly to a ball grid array in accordance with an exemplary embodiment of the present technology.
Figure 4B:
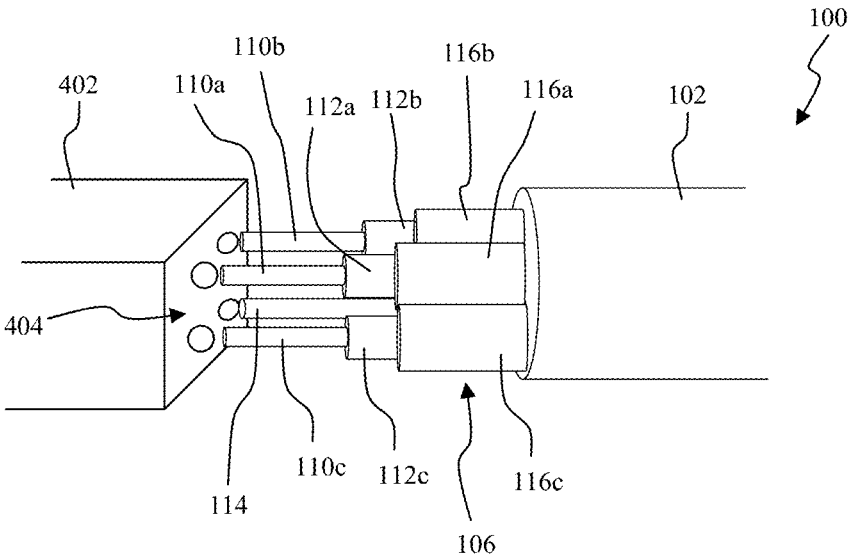
FIG. 4B representatively illustrates a perspective view of the vertical connection of the cable assembly to the ball grid array shown in FIG. 3A in accordance with an exemplary embodiment of the present technology.

By using the drain wire 114 as a common ground for the coaxial cables 104, 106, 108, much simpler connection methods may be used to connect the cable assembly 100 to any suitable source device such as a CMOS imaging sensor, an array, a camera, or the like. For example, and referring now to FIG. 4, in one embodiment, the source device may comprise a micro-camera 402 having a surface-mount interface, such as a CMOS chip with a ball grid array (BGA) 404 positioned on a surface of the micro-camera 402. Due to the drain wire 114 acting as a common ground for the coaxial cables 104, 106, 108, the distal end of the cable assembly 100 may be vertically connected to the BGA 404 such that the ends of the coaxial cables 104, 106, 108 and an end of the drain wire 114 may be directly connected to a corresponding solder ball connection point on the BGA 404 in a substantially perpendicular manner. Alternatively, the distal end of the cable assembly 100 may be connected to the BGA 404 at an angle between zero and ninety degrees, wherein only the end most portion of the coaxial cables 104, 106, 108 and the end of the drain wire 114 are bent to allow connection to the corresponding solder ball.

Connecting the coaxial cables 104, 106, 108 and the end of the drain wire 114 in this manner eliminates the need to use a jumper wire to individually ground each coaxial cable shield to the BGA 404 simplifying the connection and increasing the yields and manufacturability of the entire system. In addition, the termination length required to connect the coaxial cables 104, 106, 108 to the BGA 404 may be reduced compared to existing termination methods utilizing jumper wires while also allowing for a reduction in an overall outer diameter of the cable assembly 100. For example, a camera 402 used in medical procedures may be limited to having a maximum outer diameter of the cable assembly less than 2 millimeters. Other applications may have even stricter requirements such that the diameter of the cable assembly 100 must be less than about 1 millimeter. Having a smaller diameter may allow the cable assembly 100 to be used in additional applications that require a small form longitudinal or horizontal termination factor but still require the ability to transmit multiple power or signals over any bandwidth or attenuation.

This method of connecting the coaxial cables 104, 106, 108 and the drain wire 114 may also provide an improved ability for flexing between the micro-camera 402 and the cable assembly 100. For example, camera systems that are used to view inside the human body often require that the camera system be able to bend and adjust according to a component inner diameter used to penetrate or diagnose a human body, such as a scope, catheter, guidewire, or flexible introducer sheath. Because of this, the cable assembly 100 may have to be flexible, both overall and in the area adjacent to the camera system where the two devices are coupled together. Vertical attachment of the coaxial cables 104, 106, 108 and the drain wire 114 may reduce back-end termination dimensions lessening the distance from the micro-camera 402 that the cable assembly 100 can be terminated or flexed independently from the micro-camera 402.

Figure 5A:
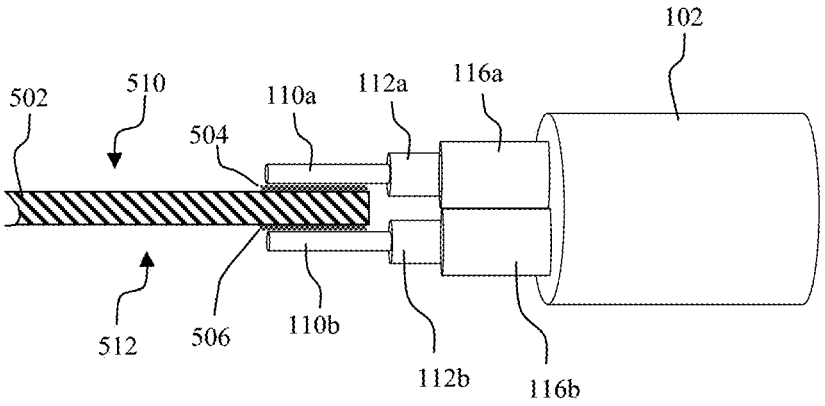
FIG. 5A representatively illustrates a side view of an edge connection of the cable assembly to a circuit board in accordance with an exemplary embodiment of the present technology.
Figure 5B:
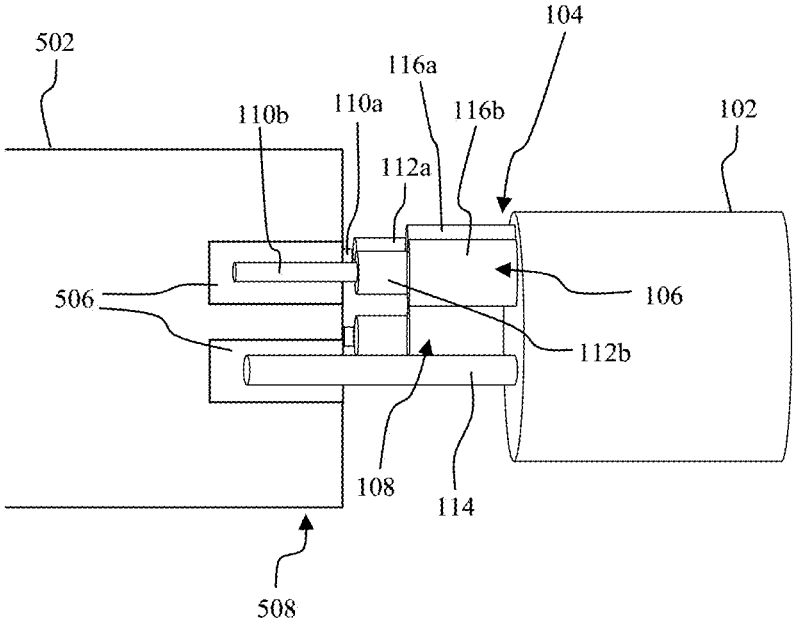
FIG. 5B representatively illustrates a bottom view of the cable assembly shown in 5A in accordance with an exemplary embodiment of the present technology.

In an alternative embodiment, and referring now to FIGS. 1, 5A, and 5B, the source device may comprise a flexible, semi-rigid or rigid substrate such as a circuit board 502 having a first set of pads 504 positioned along an upper surface 510 of an edge portion 508 of the circuit board 502 and a second set of pads 506 positioned along a lower surface 512 of the edge portion 508. Again, due to the presence of the common drain wire 114, the cable assembly 100 may be connected to the edge portion 508 such that the ends of the coaxial cables 104, 106, 108 and an end of the drain wire 114 may be soldered or otherwise connected directly to the two sets of pads 504, 506 and eliminate the need for jumper wires.

The coaxial cables 104, 106, 108 and the drain wire 114 may be disposed within the outer jacket 102 according to any suitable criteria. For example, the coaxial cables 104, 106, 108 and the drain wire 114 may be arranged into an array configured to align the wires according to a desired orientation or mapping at the receiving end to allow for easier connection to the source device. The array may be configured to pre-align each cable/wire with the corresponding connection location on the BGA 404 or the two sets of pads 504, 506. By pre-aligning the coaxial cables 104, 106, 108 and the drain wire 114, the cable assembly 100 may be terminated to the source device more rapidly and easily, since individual cables/wires do not have to be overly manipulated or otherwise processed prior to being connected to the source device. This may allow for connection by manual, semi-automated, or fully automated methods, providing greater efficiency and improved quality control in the manufacturing process.

Referring now to FIGS. 4A, 4B, 5A, 5B, and 6A-6D, the coaxial cables 104, 106, 108 and the drain wire 114 may be pre-aligned by any suitable method or process or according to any criteria. For example, in one embodiment, the coaxial cables 104, 106, 108 and the drain wire 114 may be spaced according to a layout of the BGA 404, such as a 2×2 array or a 4×1 array. Alternatively, the coaxial cables 104, 106, 108 and the drain wire 114 may be spaced according to a thickness of the circuit board 402 and the position of the pads along the edge portion 508.

Various parameters may be used to form the array and position the coaxial cables 104, 106, 108 and the drain wire 114 properly. For example, and referring now to FIGS. 7A and 7B, the coaxial cables 104, 106, 108 and the drain wire 114 may be disposed within the outer jacket 102 according to a grid 702 to create a uniform spacing between cables/wires to match a pitch on the BGA 404. In one embodiment, the grid 702 may be created by positioning the cables/wires within the array to match the pitch and holding them in position with the outer jacket 102. Additionally or alternatively, the spacing may be maintained according to the outer diameter of one or more of the coaxial cables 104, 106, 108. For example, and referring now to FIGS. 6C and 6D, the dielectric 112 thickness may be selected to support a desired outer diameter of the corresponding coaxial cable. Similarly, other components making up the coaxial cable may be adjusted to alter the outer diameter of the corresponding coaxial cable. Therefore, the positioning of the coaxial cables within the array may be modified or optimized to provide a desired spacing between the center conductors 110 of the cable assembly 100, create a desired overall size of the cable assembly 100, and/or engage a particular interface, such as a ball grid array or circuit board.

In an alternative embodiment, the spacing of coaxial cables 104, 106, 108 and the drain wire 114 may be created by a combination of both position within the outer jacket 102 and the outer diameter of one or more of the materials making up the coaxial cables 104, 106, 108 and/or the drain wire 114. In yet another embodiment, impedance requirements of one or more of the coaxial cables 104, 106, 108 may also affect the geometry and materials of the array or the spacing of the cables/wires within the array. For example, due to an overall length of the cable assembly 100 or a particular source device, the optimal impedance of one coaxial cable may be approximately 50 ohms while a second coaxial cable's optimal impedance may be between about 25-75 ohms. The center conductor 110, dielectric 112, shield 116, and outer jacket 102 for each coaxial cable may be selected or physically altered to provide the required electrical or mechanical performance while also providing a desired outer diameter to match the dimensions or pitch of the source device. Accordingly, the size of the array may be optimized to control the outer diameter of the cable assembly 100 and/or the position of the cables 104, 106, 108 and the drain wire 114 within the outer jacket 102.

By altering the position within the array of the coaxial cables 104, 106, 108 and the drain wire 114, any number of connection configurations may be created allowing the cable assembly 100 to be used with any number of different type and configurations of source devices or connection types. In this way the cable assembly 100 may be customized according to any suitable criteria. In addition, the cable assembly may be configured such that the coaxial cables 104, 106, 108 and the drain wire 114 are not twisted along the length of the cable assembly 100. By maintaining the position of the wires along the entire length of the cable assembly 100, ease of manufacturing may be further enhanced by allowing for the cable assembly 100 to be cut to a desired length without impacting the orientation of the array thereby simplifying the preparation and termination of the ends of the cable assembly 100.

Figure 6A:
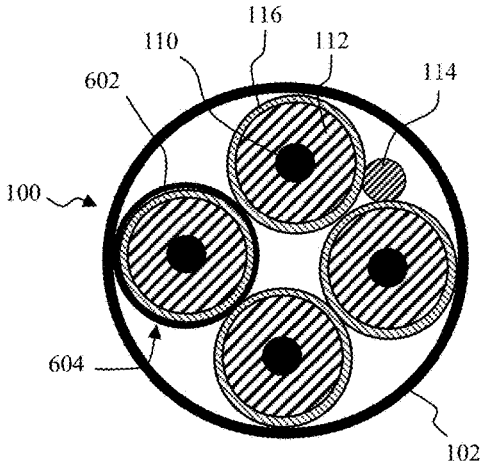
FIG. 6A representatively illustrates a cable assembly having three coaxial cables sharing a common ground and a fourth jacketed coaxial cable with an isolated shield in accordance with an exemplary embodiment of the present technology.
Figure 6B:
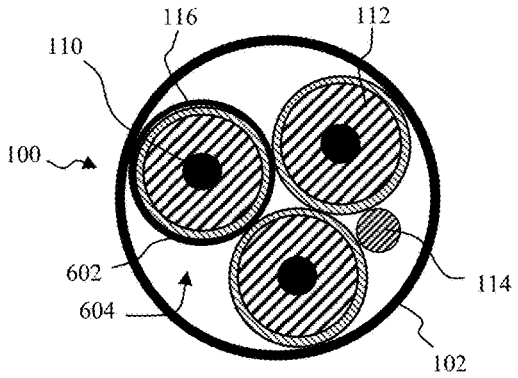
FIG. 6B representatively illustrates a cable assembly having two coaxial cables sharing a common ground and a third jacketed coaxial cable in accordance with an exemplary embodiment of the present technology.
Figure 6C:
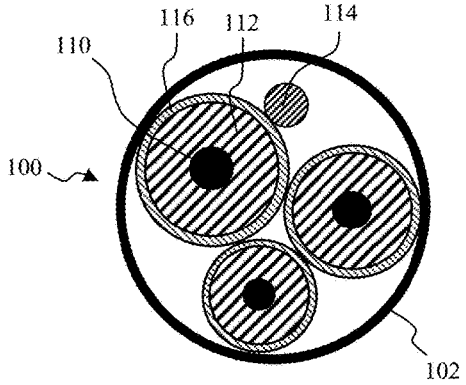
FIG. 6C representatively illustrates a cable assembly having three coaxial cables with varying dielectric thicknesses and sharing a common ground arranged in a pre-aligned array in accordance with an exemplary embodiment of the present technology.
Figure 6D:
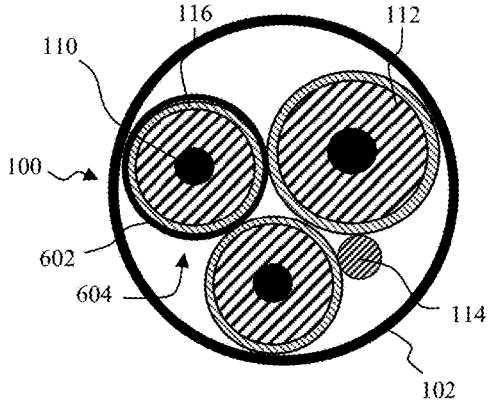
FIG. 6D representatively illustrates a cable assembly having two coaxial cables with varying dielectric thicknesses sharing a common ground and a third jacketed coaxial cable in accordance with an exemplary embodiment of the present technology.
Figure 7A:
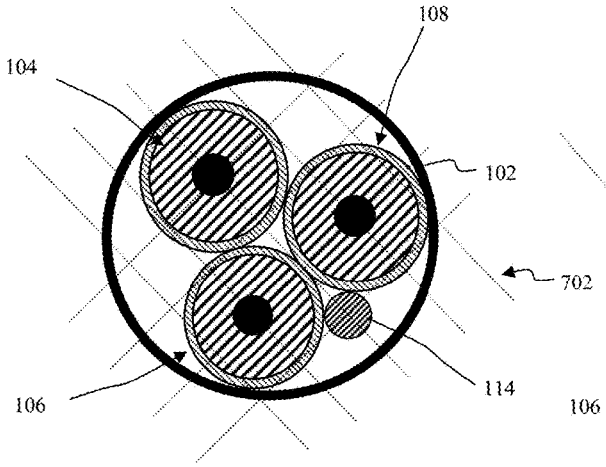
FIG. 7A representatively illustrates a grid pattern in accordance with an exemplary embodiment of the present technology.
Figure 7B:
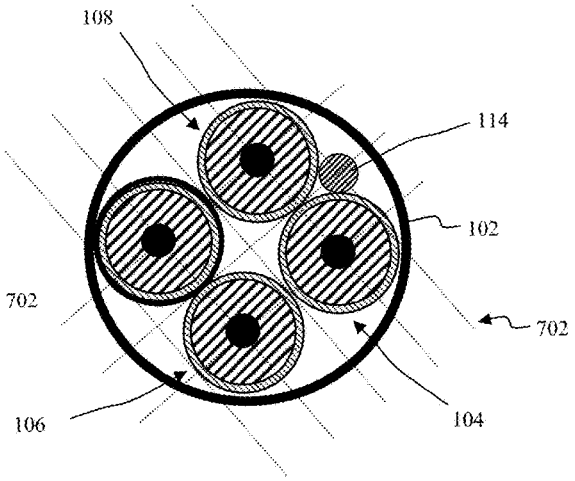
FIG. 7B representatively illustrates an alternative grid pattern in accordance with an exemplary embodiment of the present technology.

In some embodiments, and referring now to FIGS. 6A, 6B, and 6D, one or more coaxial cables may be configured as a more standard coaxial cable. Specifically, a particular coaxial cable 604 within the cable assembly 100 may be electrically insulated from the drain wire 114 and/or one or more of the other coaxial cables. For example, one of the coaxial cables may further comprise an inner sheath or insulator jacket 602 configured to cover the shield 116 and isolate that particular coaxial cable 604 from any cables without the insulator jacket 602 and the drain wire 114. This may be important in applications where one or more coaxial cables do not have to or cannot share a common ground with those coaxial cables having an exposed shield 116.

Figure 6E:
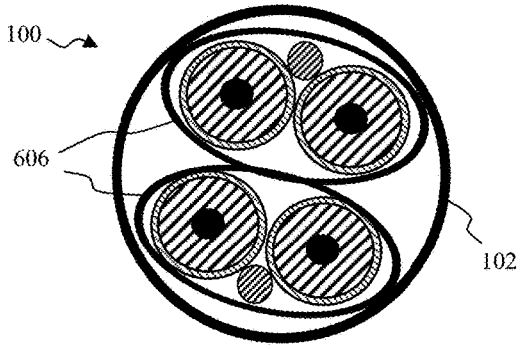
FIG. 6E representatively illustrates a cable assembly having two sets of isolated coaxial cables each having a common ground in accordance with an exemplary embodiment of the present technology.

Referring now to FIG. 6E, the cable assembly 100 may also be configured to provide multiple cable bundles, wherein each bundle is isolated from the remaining bundles by an inner bundle jacket 606 but otherwise configured as detailed above. For example, the cable assembly 100 may comprise two cable bundles wherein each bundle comprises two or more coaxial cables and may include a drain wire. Each coaxial cable within the bundle may have an exposed shield as described above or may have an inner jacket 602.

Figure 6F:
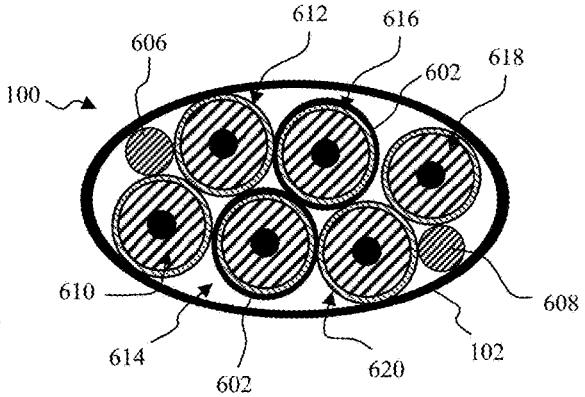
FIG. 6F representatively illustrates a cable assembly having two sets of isolated coaxial cable bundles separated by a pair of insulated coaxial cables in accordance with an exemplary embodiment of the present technology.

Referring now to FIG. 6F, the cable assembly 100 may also be configured to provide multiple isolated cable bundles, wherein each bundle is isolated from the remaining bundles by one or more insulated coaxial cables as detailed above. For example, the cable assembly 600 may comprise a first isolated bundle comprising a first and a second coaxial cable 610, 612, commonly grounded to a first drain wire 606. The cable assembly 600 may also comprise a second isolated bundle comprising a third and a fourth coaxial cable 618, 620, commonly grounded to a second drain wire 608. The first and second isolated bundles may be separated from each other by a first and second insulated coaxial cable 614, 616. The coaxial cables 610, 612, 618, 620 within the two isolated bundles may have an exposed shield as described above to allow them to be commonly grounded to their respective drain wires. The first and second insulated coaxial cable 614, 616 may comprise an inner insulator jacket 602 as described above.

Figure 6G:
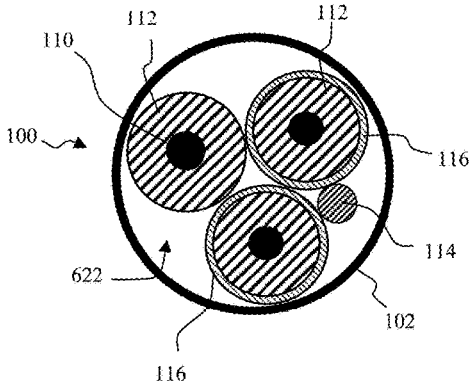
FIG. 6G representatively illustrates a cable assembly having two coaxial cables sharing a common ground and a third insulated coaxial cable in accordance with an exemplary embodiment of the present technology.

Referring now to FIG. 6G, in yet another embodiment, the cable assembly 100 may also be configured to provide an insulated unshielded cable 622 along with one or more coaxial cable having exposed shields as described above. For example, the cable assembly 100 may comprise two coaxial cables having exposed shields 116 commonly ground to a drain wire 114. The insulated unshielded cable 622 may be positioned coextensively with the other cables and be electrically isolated from the first and second coaxial cables by its dielectric 112 without the need for a jacket.

These and other embodiments for methods of forming a cable assembly may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to a exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A cable assembly for connecting to a source device having a connection layout including a ground connection, comprising:

an outer jacket;

a first and a second coaxial cable disposed within the outer jacket, wherein:

each coaxial cable comprises an exposed shield; and the exposed shield of the first coaxial cable is in contact with the exposed shield of the second coaxial cable; and a single drain wire disposed within the outer jacket coextensively with the first and second coaxial cables, wherein the drain wire is in contact with the exposed shield of at least one of the first and second coaxial cables, wherein the first and second coaxial cables and the drain wire are arranged in an array configured to pre-align the first and second coaxial cables and the drain wire to the connection layout of the source device to allow the drain wire to connect to the ground connection on the source device and act as a common ground for the first and second coaxial cables.

2. A cable assembly according to claim 1, further comprising a third coaxial cable disposed within the outer jacket, wherein:

the third coaxial cable comprises an exposed shield; and the exposed shield of the third coaxial cable is in contact with the exposed shield of at least one of the first and second coaxial cables.

3. A cable assembly according to claim 1, further comprising a third coaxial cable disposed within the outer jacket, wherein only a shield of the third coaxial cable is enclosed within an inner insulator jacket to isolate the third coaxial cable from the first and second coaxial cables.

4. A cable assembly according to claim 1, wherein the array is configured to:

align the first and second coaxial cables and the drain wire to a corresponding ball grid array; and allow the first and second coaxial cables and the drain wire to be vertically connected to the ball grid array.

5. A cable assembly according to claim 1, wherein the array is configured to:

allow the first and second coaxial cables and the drain wire to be edge connected to a circuit board; and align the first and second coaxial cables and the drain wire to a corresponding position on the circuit board.

6. A cable assembly according to claim 1, wherein a diameter of a dielectric of at least one of the first and second coaxial cables may be selected to alter a geometry of the array.

7. A cable assembly according to claim 1, wherein a dielectric of at least one of the first and second coaxial cables may be selected to create a desired impedance of the corresponding coaxial cable.

8. A cable assembly according to claim 1, wherein an outer diameter of the outer jacket is less than about six tenths of a millimeter.

9. A cable assembly according to claim 1, wherein the first and second coaxial cables and the drain wire are not twisted along a length of the cable assembly.

10. A cable assembly according to claim 1, further comprising:

a third and a fourth coaxial cable disposed within the outer jacket, wherein:

each coaxial cable comprises an exposed shield;

the exposed shield of the third coaxial cable is in contact with the exposed shield of the fourth coaxial cable; and the exposed shields of the third and fourth coaxial cables are electrically isolated from the exposed shields of the first and second coaxial cables; and a second drain wire disposed within the outer jacket and in contact with the exposed shield of at least one of the third and fourth coaxial cables.

11. An internally shielded cable assembly for connecting to a source device having a connection layout including a ground connection, comprising:

an outer jacket having an internal volume;

a plurality of coaxial cables disposed within the internal volume of the outer jacket, wherein:

each coaxial cable of the plurality of coaxial cables comprises an exposed outer shield extending along an entire length of the cable assembly;

the exposed outer shield each coaxial cable of the plurality of coaxial cables is in contact with at least one outer shield of another cable of the plurality of coaxial cables; and a drain wire disposed within the internal volume of the outer jacket coextensively with the plurality of coaxial cables, wherein the drain wire is in contact with the exposed outer shield of at least one of the plurality of coaxial cables, and wherein:

the plurality of coaxial cables and the drain wire are arranged in an array having an orientation configured to pre-align the plurality of coaxial cables and the drain wire to the connection layout of the source device to allow the drain wire to connect to the ground connection on the source device and act as a common ground for the plurality of coaxial cables.

12. An internally shielded cable assembly according to claim 11, wherein the array is configured to:

align the plurality of coaxial cables and the drain wire to a corresponding ball grid array; and allow the plurality of coaxial cables and the drain wire to be vertically connected to a corresponding solder ball connection point on the ball grid array.

13. An internally shielded cable assembly according to claim 11, wherein the array is configured to:

allow the plurality of coaxial cables and the drain wire to be edge connected to a circuit board; and align the plurality of coaxial cables and the drain wire to corresponding positions on the circuit board.

14. An internally shielded cable assembly according to claim 11, wherein a diameter of a dielectric of at least one of the plurality of coaxial cables may be selected to alter a geometry of the array.

15. An internally shielded cable assembly according to claim 11, wherein a dielectric of at least one of the plurality of coaxial cables may be selected to create a desired impedance of the corresponding coaxial cable.

16. A method of forming an internally shielded cable assembly for connecting to a source device having a connection layout including a ground connection, comprising: arranging a plurality of coaxial cables and a single drain wire in an array configured to pre-align the plurality of coaxial cables and the drain wire to the connection layout of the source device to allow the drain wire to connect to the ground connection on the source device, wherein: each coaxial cable comprises an exposed shield; the exposed shield of a first coaxial cable from the plurality is in contact with the exposed shield of a second coaxial cable from the plurality; and the drain wire is in contact with the exposed shield of at least one of the plurality of coaxial cables and acts as a common ground for the plurality of coaxial cables: and enclosing the plurality of coaxial cables and the drain wire within an outer jacket.

17. A method of forming an internally shielded cable assembly according to claim 16, further comprising positioning an additional coaxial cable proximate the plurality of coaxial cables within the outer jacket, wherein only the additional coaxial cable is enclosed within an inner jacket and electrically insulated from the exposed shields of the plurality of coaxial cables.

18. A method of forming an internally shielded cable assembly according to claim 16, further comprising positioning a second plurality of coaxial cables and a second drain wire within the outer jacket according to the connection layout of the source device, wherein:

each coaxial cable from the second plurality of coaxial cables comprises an exposed shield;

the exposed shield of a first coaxial cable from the second plurality is in contact with the exposed shield of a second coaxial cable from the second plurality;

the second drain wire is in contact with the exposed shield of at least one coaxial cable from the second plurality of coaxial cables and connects to a second ground connection on the connection layout to act as a common ground for the second plurality of coaxial cables; and the second plurality of coaxial cables and the second drain wire are electrically insulated from the exposed shields of the first plurality of coaxial cables and the first drain wire.

19. A method of forming an internally shielded cable assembly according to claim 16, wherein the array comprises a spacing between each coaxial cable and the single drain wire to allow the cables to be edge connected to a circuit board, wherein each wire is pre-aligned to a corresponding connection position on the circuit board.

20. A method of forming an internally shielded cable assembly according to claim 16, wherein the array comprises a spacing between each coaxial cable and the single drain wire to allow the cables to be vertically connected to a ball grid array, wherein each wire is pre-aligned to a corresponding solder ball connection point on the ball grid array.

21. A method of forming an internally shielded cable assembly according to claim 16, wherein a thickness of a dielectric of one or more coaxial cables from the plurality of coaxial cables may be selected to properly align the plurality of coaxial cables within the array.

* * * * *